United States Patent [19]

Murakami et al.

[11] Patent Number: 4,543,071

[45] Date of Patent: Sep. 24, 1985

[54] APPARATUS FOR PRODUCING A MAGNETRON

[75] Inventors: Hiroya Murakami; Mitsuhiro Takasaki, both of Yokohama, Japan

[73] Assignee: Hitachi, Ltd., Tokyo, Japan

[21] Appl. No.: 568,266

[22] Filed: Jan. 4, 1984

Related U.S. Application Data

[63] Continuation-in-part of Ser. No. 311,970, Oct. 16, 1981, abandoned.

[30] Foreign Application Priority Data

Oct. 22, 1980 [JP] Japan ..... 55-146826

[51] Int. Cl.[4] ..... H01J 9/00

[52] U.S. Cl. ..... 445/66; 29/602 R; 29/564.2; 225/106; 315/39.51; 445/35

[58] Field of Search ..... 29/602 R, 157.3 AH, 29/157.3 A, 564, 564.1, 564.2, 564.3, 33 Q, 335, 446, 456; 72/129, 136, 137; 315/39.51; 445/35, 66; 225/2, 106

[56] References Cited

U.S. PATENT DOCUMENTS

| | | | |
|---|---|---|---|
| 601,429 | 3/1898 | Caldwell | 72/136 |
| 2,372,795 | 4/1945 | Rodeck | 72/137 |
| 3,388,449 | 6/1968 | McElroy | 29/727 |
| 3,427,427 | 2/1969 | Rudd | 29/157.3 AH |
| 4,105,913 | 8/1978 | Yamano et al. | 315/39.51 |
| 4,236,299 | 12/1980 | Joekel et al. | 29/157.3 AH |
| 4,353,162 | 10/1982 | Van Meteren | 29/157.3 AH |

FOREIGN PATENT DOCUMENTS

| | | | |
|---|---|---|---|
| 35863 | 3/1980 | Japan | 29/157.3 AH |

*Primary Examiner*—Howard N. Goldberg
*Assistant Examiner*—P. W. Echols
*Attorney, Agent, or Firm*—Antonelli, Terry & Wands

[57] ABSTRACT

To increase production of magnetrons, a spiral fin is wound on a magnetron body as soon as it is produced, and a leading end and a trailing end of the fin are fixed to the magnetron body. This increases the number of turns of the fin wound on the magnetron body and improves the bond strength with which the fin is bonded to the magnetron body to thereby increase the effect achieved by the fin in dissipating heat and avoiding a decline in the performance characteristics of the magnetron.

3 Claims, 8 Drawing Figures

APPARATUS FOR PRODUCING A MAGNETRON

BACKGROUND OF THE INVENTION

This application is a continuation-in-part of U.S. application Ser. No. 311,970 filed Oct. 16, 1981, now abandoned.

The present invention relates to a method of producing a magnetron by winding a spiral-shaped metallic fin on a magnetron body and an apparatus for carrying out such method.

A magnetron has been proposed which includes a heat dissipating fin, in the form of a spiral disposed on an outer peripheral edge of the magnetron body for more effective heat dissipation and for obtaining better performance characteristics.

In attaching a fin to the magnetron body, the fin, formed spirally beforehand with a relatively rough pitch and having an inner diameter slightly smaller than an outer diameter of the magnetron body, is cut to a predetermined length before being compressed to reduce the pitch and increase the inner diameter. The magnetron body is inserted into the spiral fin and a compressive force acting on the fin is removed so as to allow the fin to expand by its own resilience. Thus, the fin has its inner diameter reduced to clamp the magnetron body by the fin so as to attach the fin to the magnetron body.

One advantage of a magnetron of the aforementioned construction resides in the fact that it is possible to carry out heat dissipation more effectively than in cross-fin type magnetrons having an annular fin force fitted thereon. By virtue of the more efficient heat dissipation, it is possible to avoid a decline in the performance characteristics of the magnetron. Yet another advantage resides in the fact that the attaching of the fin to the magnetron body is facilitated so as to thereby enable an increase in productivity.

However, there are certain disadvantages associated with a magnetron of the aforementioned type. More particularly, it is difficult to obtain a sufficient number of turns of the fin when wound on the magnetron body to achieve a satisfactory dissipation of heat and, consequently, a satisfactory bond is unattainable between the magnetron body and the fin.

More particularly, the greater the difference between the outer diameter of the outer peripheral edge of the magnetron body and the inner diameter of the fin, the higher the bonding force acting between the magnetron body and the fin. On the other hand, when the fin is compressed in attaching the same to the magnetron body, the expansion of the inner diameter of the fin is proportional to the compression of the fin so that the expansion of the inner diameter increases as the compression increases. Thus, to obtain a satisfactory bonding force acting between the fin and the magnetron body, it is necessary to provide the fin with a rough pitch so as to enable a sufficient amount of compression to be obtained when the fin is attached to the magnetron body. This reduces the number of turns of the fin on the magnetron body and, consequently, the area of heat dissipation is also reduced making it impossible to effect heat dissipation efficiently and effectively. If the number of turns of the fin on the magnetron body is increased, the bonding force acting between the magnetron body and the fin would be reduced and a transfer of heat would be disturbed thereby reducing the efficiency with which heat is dissipated through the fin.

Additionally, in a magnetron of the aformentioned type, since the fin is merely wound on the magnetron body, the possibility exists that the fin might become loose and then become dislodged from the magnetron body while the magnetron is in use.

SUMMARY OF THE INVENTION

The aim underlying the present invention essentially resides in providing a method and apparatus for producing a magnetron wherein a fin in the form of a spiral is wound on a magnetron body with a sufficiently high bonding force and with a sufficient number of turns so as to ensure the obtaining of high performance characteristics.

In accordance with advantageous features of the present invention, one longitudinal side of a metal strip is bent into an L-shape and temporarily fixes one end of a fin to the outer peripheral edge of the magnetron body, while the other longitudinal side is rolled to form the fin of a spiral shape. The fin is wound on the magnetron body as soon as it is formed and wound in a number of turns required before the leading end and trailing end of the fin are secured in place. The fin is then severed posteriorly of the fixed portion.

In the fixing of a spiral fin, two adjacent convolutions at a leading and trailing end portion of the spiral fin including, for example, ten or more convolutions, are fixed to each other. Experience has demonstrated that a spiral fin, in order to become loose from a tubular body such as a magnetron body to which it is fastened, generally starts at opposite ends of the spiral fin. Thus, to avoid unfastening of the spiral fin from the magnetron body at opposite ends, in accordance with the present invention, the adjacent two convolutions at the leading and trailing end portions of the fin are secured to each other.

In fixing the adjacent two convolutions at the trailing and leading end portions of the fin, in accordance with the present invention, a cutting and bending process is employed. More particularly, at the leading or trailing end portion of the spiral fin, two adjacent convolutions are provided with two parallel cuts made at an outer peripheral portion to form two strip-like segments in the fin, with the two strip-like segments being bent so that they overlap and are disposed on intermediate portions of the convolutions.

The above and other objects, features, and advantages of the present invention will become more apparent from the following description when taken in connection with the accompanying drawing which shows, for the purposes of illustration only, one embodiment in accordance with the present invention, and wherein.

DETAILED DESCRIPTION

Figure 1:
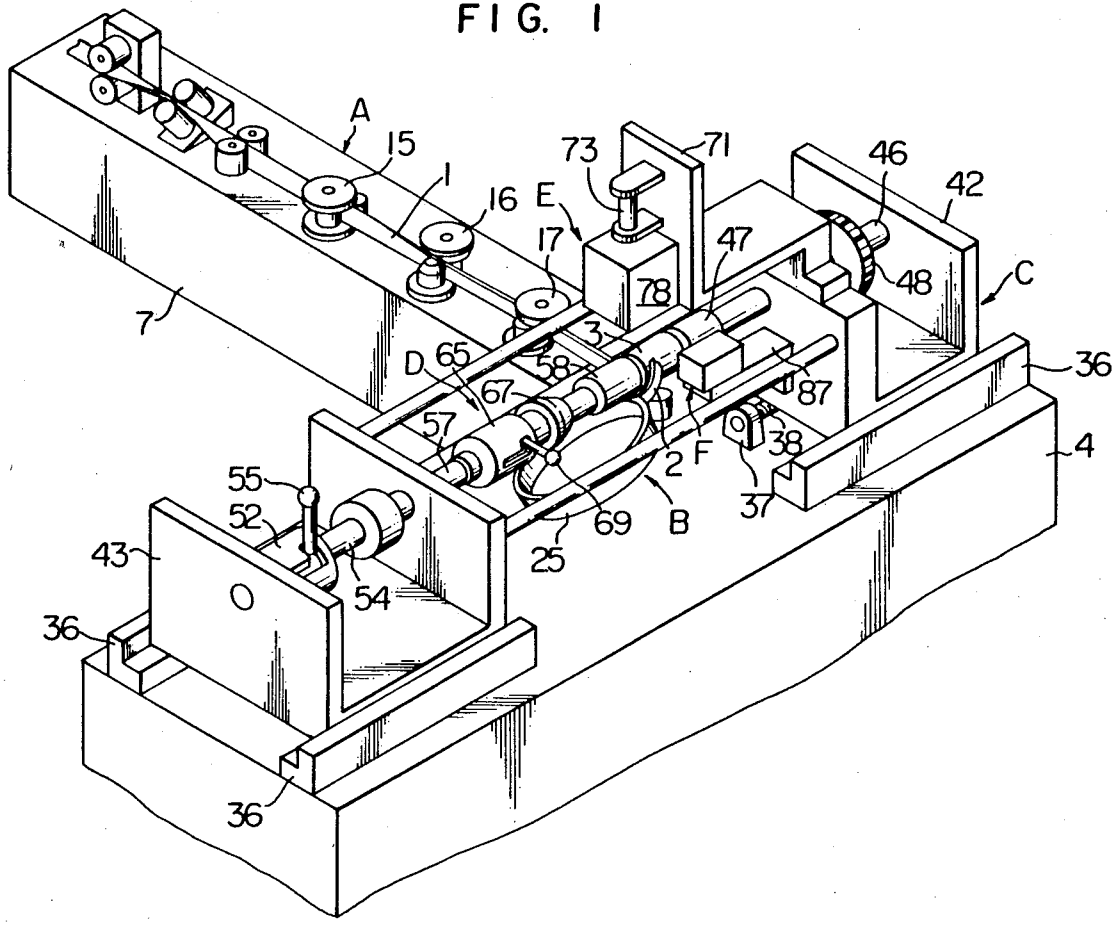
FIG. 1 is a perspective view of the apparatus for producing a magnetron comprising one embodiment of the invention.

Referring now to the drawings wherein like reference numerals are used throughout the various views to designate like parts and, more particularly, to FIG. 1, according to this figure, an apparatus for producing a magnetron comprises a supply station generally designated by the reference character A, a working station generally designated by the reference character B, a holding station generally designated by the reference character C, a temporary fixing station generally designated by the reference character D, a fixing station generally designated by the reference character E, and a cutting station generally designated by the reference character F. At the supply station A, material 1, in hoop form wound in a coil, is withdrawn and bent along one side thereof at a right angle into an L-shape before being supplied to the next station. At the working station B the other side of the material 1 is rolled to form the material 1 into a spiral shape to provide a spiral fin 2. The holding station C holds a magnetron 3 in such a manner that it is disposed on the center axis of the fin 2 formed in the working station B and rotates the magnetron body 3 and moves the same in an axial direction in synchronism with the operation performed in the working station B so as to wind the fin 2 on the magnetron body 3. The temporary fixing station D forces the leading end of the fin 2 worked in the working station B aginast the magnetron body 3 held in the holding station C and temporarily fixes the same thereto. The fixing station E fixes the leading end and the trailing end of the fin 2 to the magnetron body 3 after the fin 2 is wound on the magnetron body 3. The cutting station F makes a cut in the fin 2 in a position posterior to the portion in which the fin 2 is fixed.

Figure 2:
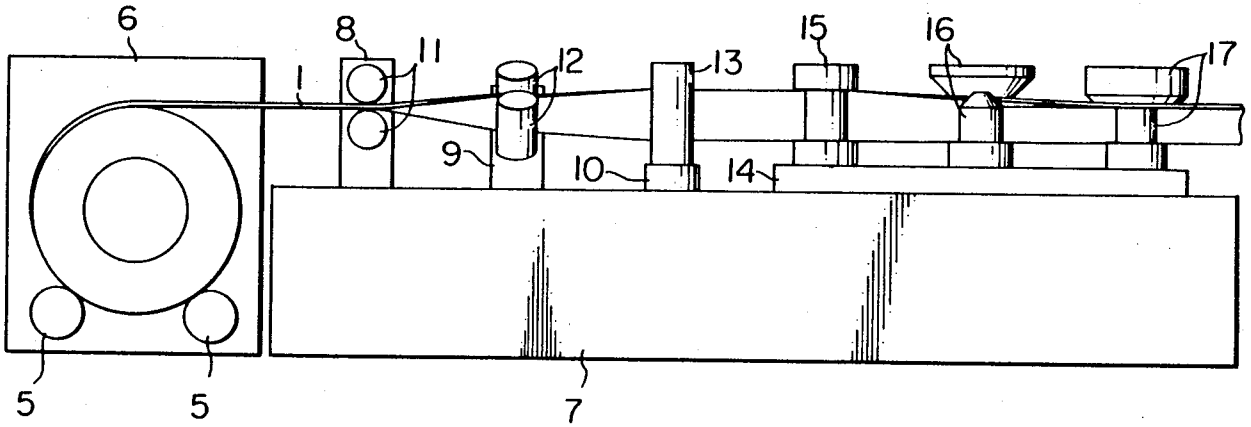
FIG. 2 is a side view of the material supply station shown in FIG. 1.

As shown in FIGS. 1 and 2, in the supply station A, the material 1, wound in coil form, is supported by a support device 6 having a pair of rotatable rollers 5. Three sets of guide rollers 11, 12 and 13 are arranged on a table 7 through pedestals 8, 9 and 10 to guide the material 1 as it shifts from a horizontal position to a vertical position. One set of guide rollers 15, one set of working rollers 16, and one set of second working rollers 17 are arranged on the table 7 through a bed 14. The guide rollers 15 and the working rollers 16, 17 are rotated in synchronism with one another from a drive source (not shown).

In the above described apparatus, the material 1, withdrawn from the support device 6, is given a twist by the guide rollers 12, 13 and then at its vertical position is regulated by the guide rollers 15. Thereafter, the working rollers 16 bend one side of the material 1 through about 45° and the working rollers 17 bend the same through 90° to form the material 1 into an L-shape.

Figure 3:
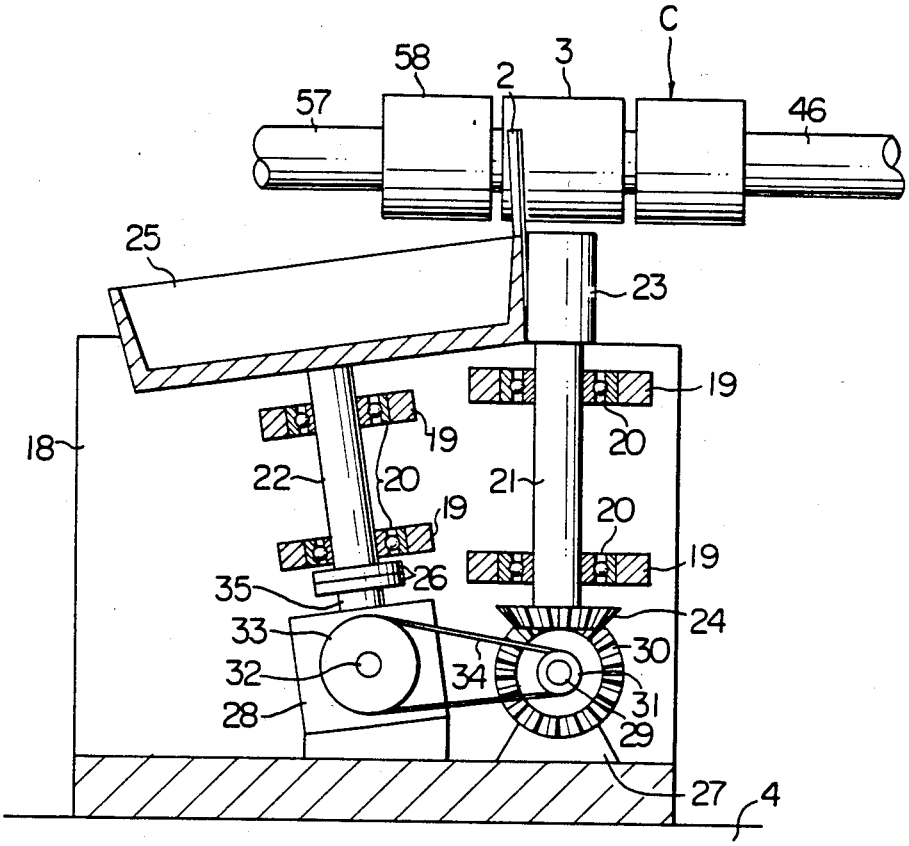
FIG. 3 is a sectional front view of the fin working station shown in FIG. 1.

As shown in FIG. 3, the working station B is supported on a frame 18 on a table 4, with the frame 18 being formed with two sets of cross-pieces 19 rotatably supporting shafts 21, 22, respectively, through bearings 20. The shaft 21 is supported in a manner so as to have its center axis disposed vertically, and the shaft 22 is supported in such a manner that its center axis is inclined at a predetermined angle with respect to the shaft 21. The shaft 21 has a rolling roll 23 of a minor diameter secured to its upper end and a gear 24 secured to its lower end. Meanwhile, the shaft 22 has a rolling roller 25 of a major diameter secured to its upper end and is formed with a flange 26 at its lower end. A motor 27 and a speed reducing gearing 28 are arranged at a bottom of the frame 18. The motor 27 has a rotary shaft 29 having a gear 30 and pulley 31 secured thereto, with the gear 30 being in meshing engagement with the gear 24. The speed reducing gearing 28 has an input shaft having a pulley 33 secured thereto, and a belt 34 is trained over the two pulleys 31, 33. The speed reducing gearing 28 includes an output shaft 35 formed with a flange 26 connected to the flange 26 of the shafts 22 in a unitary structure. A guide **18*a* (FIG. 4) is provided for inserting the material between the rolls 23, 25**.

An actuation of the motor 27 causes the rolls 23, 25 to rotate in synchronism, and an insertion of the material 1 between the rolls 23, 25 results in the material 1 being rolled. By setting the spacing interval between the rolls 23, 25 in such a manner that the upper portions thereof have a larger spacing interval and the lower portions thereof have a smaller spacing interval, the material 1 can be spirally bent by rolling by the difference in the widthwise rolling reduction obtained in the material 1 thereby forming the fin 2.

Figure 4:
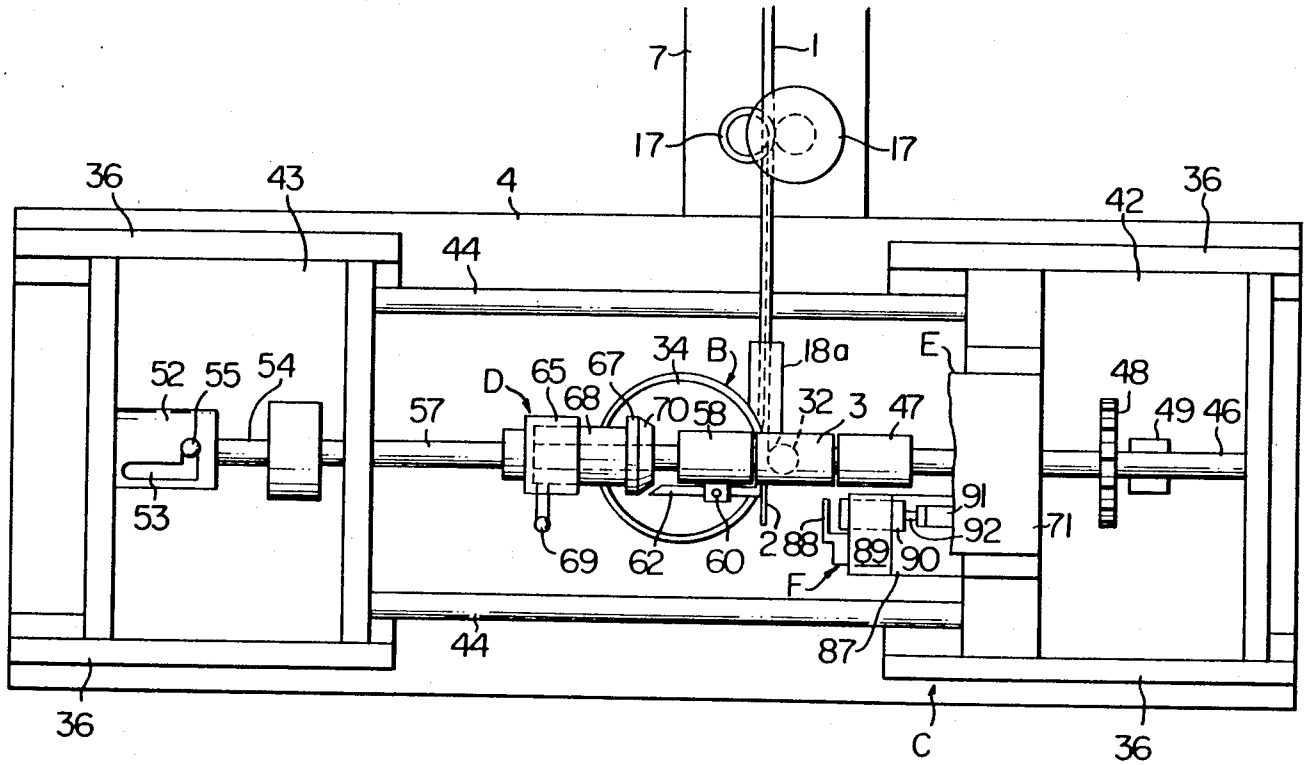
FIG. 4 is a plan view of the magnetron body holding station shown in FIG. 1.
Figure 5:
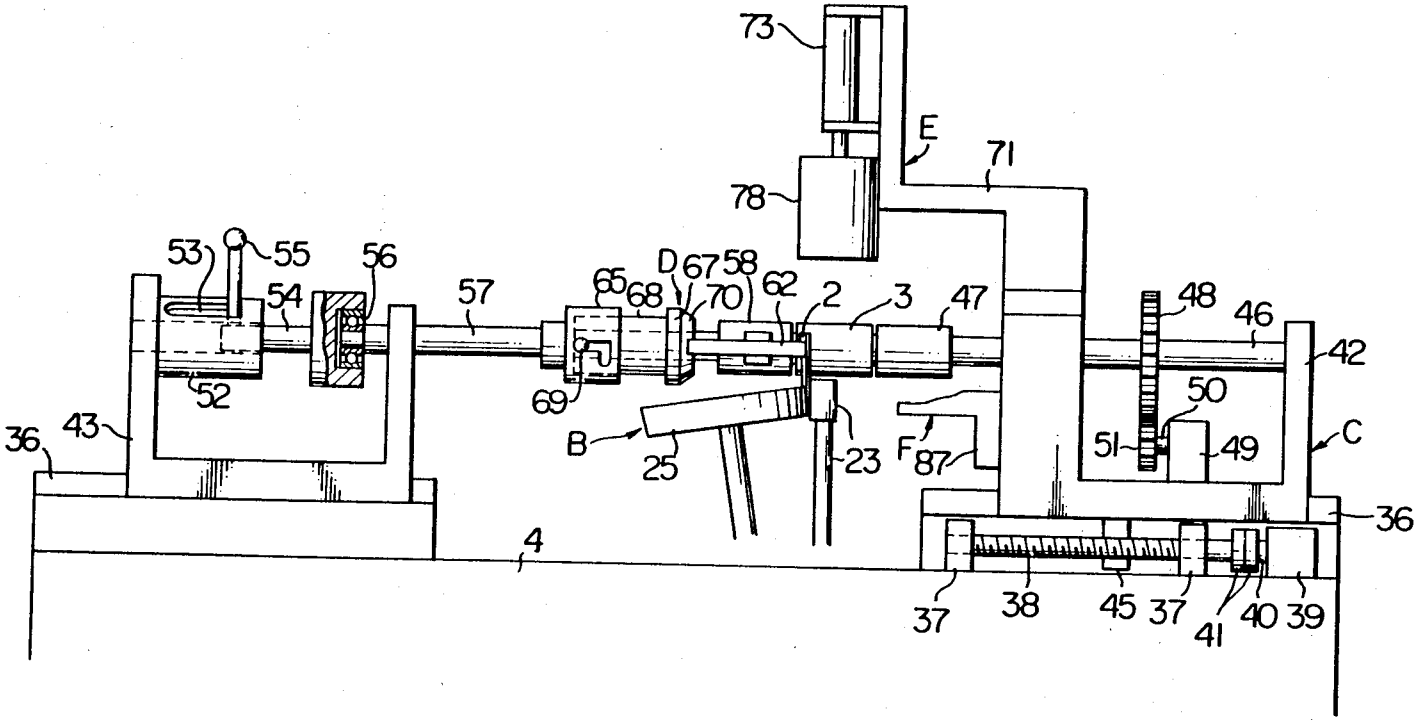
FIG. 5 is a front view of the magnetron body holding station shown in FIG. 4.

As shown in FIGS. 1, 4, 5, the holding station C is compossed of a movable section supported on rails 36 on the table 4 and a drive section for driving the movable section, with the drive section including a feed screw 38 rotatably supported by a pair of bearings 37 vertically mounted on the table 4, and a motor 39 located on the table 4 and having a rotary shaft 40 connected to the feed screw 38 through flanges 41. The movable member is supported by a pair of U-shaped sliders 42, 43 slidably placed on the rails 36 and connected together by a pair of connecting rods 44. The slider 42 includes a nut 45 mounted on its undersurface for threadable engagement with the feed screw 38. An actuation of the motor 39 causes the feed screw 38 to rotate thereby moving the sliders 42, 43 simultaneously in the same direction. The slider 42 has a shaft 46 rotatably supported thereby, with the shaft 46 having a chuck 47 secured to one end thereof for holding the magnetron body 33. A gear 48 is secured to the central portion of the shaft 46, and a motor 49 is mounted on a bottom surface of the slider 42 and includes a gear 51 secured to a rotary shaft 50 thereof and meshing with the gear 48. Thus, an actuation of the motor 49 causes the shaft 46 to rotate. The slider 43 has a cylindrical guide 52 secured thereto and formed on its cylindrical surface with an L-shaped groove 53. The guide 52 has one end of a shaft 54 slidably and rotatably fitted in the center axis thereof, with the shaft 54 having, at one end thereof, a lever 55 slidably extending through the groove 53 and, at the other end thereof, a bearing 56 journaling one end of a shaft 57 slidably and rotatably extending through the slider 43. The other end of the shaft 57 has a chuck secured thereto juxtaposed against the chuck 58 for holding the magnetron body 3. Thus, by moving the lever 55 along the groove 53 of the guide 52, it is possible to move the shafts 54 and 57 in sliding movement in the direction of their center axes so as to thereby vary the spacing interval between the chucks 47, 58 and to enable the magnetron body 3 to be gripped by and released from the chucks 47, 58. As the shaft 46 rotates with the magnetron body 3 being held by the chucks 47, 58, the shaft 57 is rotated at the same time with the magnetron body 3.

By virtue of the above-noted construction features of the present invention, it is possible to have the magnetron body 3 gripped and held by the chucks 47, 58 by moving the lever 55 to move the chuck 58 rearwardly and moving the lever 55 toward the chuck 47 after inserting one end of the magnetron body 3 in the chuck 47, followed by inserting the other end of the magnetron body 3 in the chuck 58. When it is desired to release the magnetron body 3 from the chucks 47, 58, it is only necessary to reverse the above described operation. By actuating the motors 39, 49 in synchronism with the operation of the working station B, it is possible to wind the fin 2 formed in the working station B on the magnetron body 3 with a desired spacing interval or a pitch between the convolutions.

Figure 6:
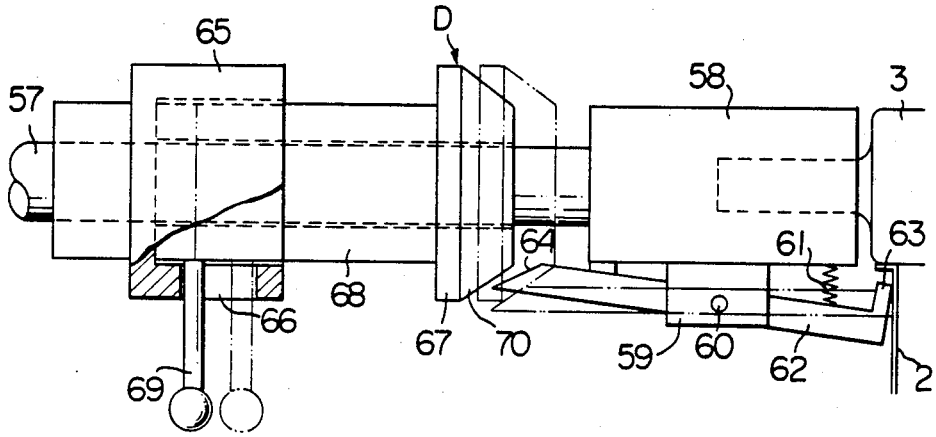
FIG. 6 is a plan view of the temporarily fixing station shown in FIG. 1.

As shown in FIGS. 1, 4, and 6, the temporary fixing station D is supported by the shaft 57 and the chuck 58. A lever 62, rotatably supported by a shaft 60 and journaled by a bearing 59 projecting from the chuck 58 and urged by a spring 61 to move in a pivotal movement, is formed at one end portion, on the side of the magnetron body 3, with a holding portion 63 for pressing the fin 2 against the magnetron body 3 thereby temporarily fixing the same and, at the other end portion thereof, with a cam 64. The shaft 57 has a guide 65 secured thereto, with the guide 65 being formed with an L-shaped groove 66 and defining a stepped recess. Slidably and rotatably fitted between the shaft 57 and the guide 65 is a shaft portion 68 of a cam 67 slidably and rotatably fitted to the shaft 57. A lever 69, slidably extending through the groove 66 of the guide 65, is mounted perpendicular to the shaft portion 68. The cam 67 is formed, at one end thereof, with a cam 70 juxtaposed against the cam 64 formed on the lever 62.

With the above described construction, movement of the lever 69 from the side of the slider 43 toward the side of the chuck 58 causes the cam 70 to press the cam 64 to move the lever 62 in pivotal movement thereby forcing the fin 2 against the magnetron body 3 by the hold down portion 63 of the lever 62. Thus, the fin 2 can be temporarily fixed to the magnetron body 3. The temporary fixing station D rotates together with the shaft 57 and chuck 58 at the same time, so that there is no risk of the fin 2 being released from the temporary fixing with respect to the magnetron body 3 while the fin 2 is being wound on the magnetron body 3. When it is desired to release the fin 2 from the temporary fixing, it is only necessary to move the lever 69 from the side of the chuck 58 toward the side of the slider 43.

Figure 7:
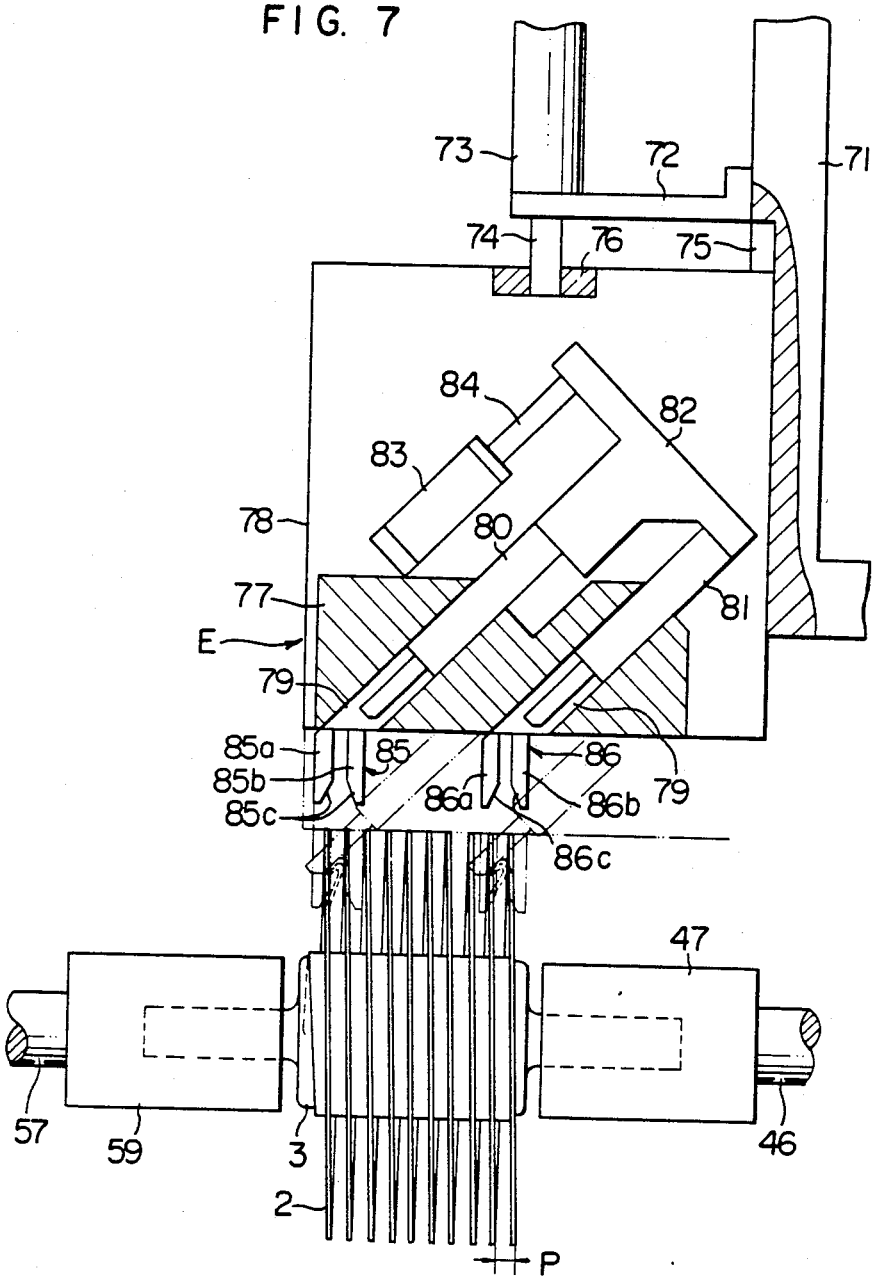
FIG. 7 is a sectional front view of the fixing station shown in FIG. 1.

As shown in FIG. 7, the fixing station E is supported by a base 71 secured to the slider 42 and supporting an air cylinder 73, hereinafter referred to as a cylinder, through a support plate 72 in such a manner that a rod 74 is disposed in an upstanding position. The base 71 is formed with a guide groove 75 having slidably fitted therein a frame 78 supporting a crosspiece 76 and a guide block 77, with the crosspiece 76 being secured to the rod 74 of the cylinder 73. Thus, actuation of the cylinder 73 causes the frame 78 to move in an elevatory movement along the groove 75. The guide block 77 is formed with a pair of parallel guide openings 79 having a punch 80 fitted therein for sliding movement, with the punch 80 being adapted to fix a leading end portion of the fin 2 and a punch 81 for fixing a trailing end portion thereof. The punches 80 and 81 are secured, at one end thereof, to a punch holder 82 connected to a rod 84 of an air cylinder 83, hereinafter referred to as a cylinder, attached to the frame 78. Thus, actuation of the cylinder 83 causes the punches 80, 81 to move in sliding movement in the respective guide opening 79. The guide block 77 has dies generally designated by the reference numerals 85, 86 projecting downwardly from the lower end surface thereof in positions corresponding to those of the ends of the guide opening 79. The dies 85, 86 are composed of a pair of die members 85*a*, 85*b* and another pair of die members 86*a*, 86*b*, respectively. The respective pairs of die members 85*a*, 85*b* and 86*a*, 86*b* are spaced apart from each other by a distance less than a pitch of the convolutions of the fin 2 to be fixed and chamfered at 85*c* and 86*c*, respectively, for guiding the fin 2.

With the above described construction, as the fin 2 is wound on the magnetron body in the required number of turns and the magnetron body 3 becomes stationary, the cylinder 73 is actuated to move the frame 78 downwardly. This causes the dies 85, 86 to move downwardly to grip adjacent convolutions of the fin 2. Then the cylinder 83 is actuated to cause the punches 80, 81 to project outwardly from the guide block 77 and extend through the dies 85, 86, respectively, so that adjacent convolutions of the fin 2 gripped by the dies 85, 86 are cut and bent by the punches 80, 81 in such a manner that one of the adjacent convolutions overlaps the other convolution of the fin 2, so that the relative positions of the two adjacent convolutions of the fin are fixed. Thus, the fin 2 is able to retain the tension it had when it was wound on the magnetron body 3 so that the fin 2 is secured in place on the magnetron body 3. Upon completion of the fixing of the fin 2, the cylinder 83 is actuated to restore the punches 80, 81 to their original positions, and the cylinder 73 is actuated to move the frame 78 upwardly to release the dies 85, 86 from between the convolutions of the fin 2.

Figure 8:
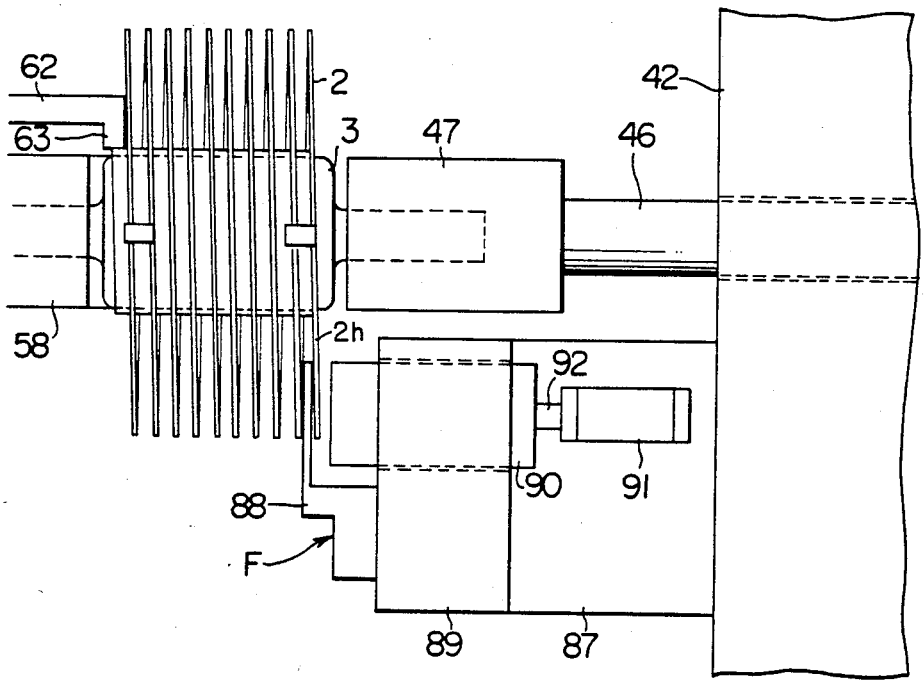
FIG. 8 is a plan view of the cutting station shown in FIG. 1.

As shown in FIGS. 4 and 8, the cutting station F is supported by a base 87 secured to the slider 42 and having a fixed blade 88 secured to its forward end. The base 87 has a guide 89 secured to its upper surface for supporting a movable blade 90 for sliding movement, with the movable blade 90 cooperating with the fixed blade 88. The movable blade 90 is connected to a rod 92 of an air cylinder 91, hereinafter cylinder, supported by the base 87. Thus, the movable blade 90 moves in sliding movement as a cylinder 91 is actuated.

Since the fixed blade 88 and the magnetron body 3 are disposed in constant relative axial positions, the fixed blade 88 is brought into position in which it is juxtaposed against the movable blade 90 with a portion 2*h* of the convolution of the fin 2 being interposed therebetween as the fixed blade is inserted between the convolutions of the fin 2 while the later are being formed on the magnetron body 3. Then, after the magnetron body 3 becomes stationary, and the fin 2 is fixed in place, the cylinder 91 is actuated to move the movable blade 90 forwardly and to cooperate with the movable blade 88 to cut the fin 2 to form a slit which has a length of over 50% of the height of the fin 2 in the portion 2*h* of the fin 2. Then the movable blade 90 moves rearwardly, and the motor 49 of the holding station C is actuated to cause the magnetron body 3 to rotate thereby tearing the partially cut portion of the fin 2 apart from the rest of the fin 2.

The material 1, wound in coil form and supplied on the rollers of the support device 6, is withdrawn at one end portion thereof and passed through the guide rollers 11, 12, 13, and the guide rollers 15. The material is then bent at one side thereof through 90° by the working rollers 16, 17 before being fed between the rollers 23, 25 of the working station B. Rotation of the rolls 23, 25 bends the material 1 by rolling to produce the fin 2. At this time, as the leading end of the fin 2 passes below the hold down portion 63 of the lever 62 of the temporary fixing station D, the rolls 23, 25 stop rotating. Meanwhile, the lever 55 of the holding station C is moved toward the slider 42 to hold the magnetron body 3 between the chucks 47, 58. Then the lever 69 of the temporary fixing station D is moved toward the chuck 58 to move the lever 62 in a pivotal movement through the cam 67 so as to force the leading end portion of the fin 2 against the magnetron body 3 to temporarily fix the former to the latter. The motors 27, 39 and 49 of the working station B and holding station C are actuated to form the fin 2. At the same time, the magnetron body 3 is moved axially while being rotated to thereby wind the fin 2 on the magnetron body 3 in a predetermined number of turns at a desired pitch. Upon completion of the winding of the fin 2 in a predetermined number of turns, the motors 27, 39 and 49 stop rotating. Then the cylinder 73 of the fixing station E is actuated to move the frame 78 downwardly to thereby actuate the cylinder 83 to cause the punches 80, 81 to project forwardly and secure in place the leading end and trailing end of the fin 2. Thereafter, the punches 80, 81 move rearwardly and the frame 78 moves upwardly. This actuates the cylinder 91 of the cutting station F to cause the movable blade 90 to project so as to form a slit on an outer peripheral portion of the fin 2. After the movable blade 90 is moved rearwardly, only the motor 49 is actuated, while the material 1 is held between the rolls 23 and 25 which are stationary to rotate the magnetron body 3 to tear the fin 2 into discrete portions by cutting into it through the slit. Then the lever 69 is moved toward the side of the slider 43 to release the fin 2 from the temporary fixing with respect to the magnetron body 3 by the lever 62, and the lever 55 is moved rearwardly to separate the chuck 58 from the chuck 47 so as to enable a removal of the magnetron body 3 from between the two chucks 58, 47.

From the foregoing, it will be appreciated that, in accordance with the present invention, when a fin 2 of the spiral form is produced, the fin 2 is directly wound on the magnetron body 3 and its opposite ends are fixed thereby making it possible to increase the bonding force acting between the magnetron body 3 and the fin 2. Additionally, it is possible to wind the fin 2 on the magnetron body 3 in a required number of turns thereby enabling the magnetron body 3 to be cooled satisfactorily while in service and allowing the performance characteristics of the magnetron to be improved. Moreover, the leading end and trailing end of the fin 2 are fixed without loosening the tension of the fin 2 when it is wound on the magnetron body 3 so that it is possible to avoid a dislodging of the fin 2 from the magnetron body 3.

In the above described embodiment, the fin 2 is described as being fixed by being bent; however, the leading end and trailing end of the fin 2 may be fixed to the magnetron body 3 by, for example, suitable fasteners such as screws or rivets or by welding. Also, the convolutions of the fins 2 may be fixed by welding. In fixing the fin 2 to the magnetron body 3, the leading end of the fin 2 may be fixed before winding is initiated the trailing end of the fin 2 may be fixed after the winding is completed. In this situation, the temporary fixing station D can be eliminated and only one punch and one die may be used in the fixing station E.

Known collet chucks may be used as chucks for holding the magnetron body 3. Alternatively, an annular rubber member may be adhesively attached to the end surface of a cylinder to press against the magnetron body 3 to hold the same.

While we have shown and described only one embodiment in accordance with the present invention, it is understood that the same is not limited thereto but is susceptible of numerous changes and modifications as known to one having ordinary skill in the art, and we therefore do not wish to be limited to the details shown and described herein, but intend to cover all such modifications as are encompassed by the scope of the appended claims.

We claim:

1. An apparatus for producing a magnetron, the apparatus comprising:

a supply station including a plurality of sets of guide rollers and working rollers arranged for bending one side of a strip of fin material into a substantially L-shape;

a working station for receiving the material from the supply station, the working station including a pair of rolling rolls including a major diameter rolling roll and a minor diameter rolling roll for rolling the other side of the material to produce a spiral fin;

a holding station including a pair of holding members arranged in such a manner that center axes thereof coincide with a center axis of the fin produced in the working station for holding a magnetron body and for moving the magnetron body in an axial direction while rotating the same;

a fixing station facing a base of the fin produced in the working station for fixing the base to the magnetron body; and a cutting station including a fixed blade positioned between the working station and the fixing station, a movable blade juxtaposed against the fixed blade with the fin being held therebetween for partially cutting the fin, and means for rotating the magnetron body subsequent to the partial cutting thereof so as to separate the fin fixed to the magnetron body from the strip of fin material.

2. An apparatus for producing a magnetron, the apparatus comprising:

a supply station including a plurality of sets of guide roller means and working roller means for bending one side of a strip of fin material into a substantially L-shape;

a working station for receiving the material from the supply station, the working station including a pair of rolling rolls including a large diameter rolling roller and a small diameter rolling roller for rolling the other side of the material to produce a spiral fin;

a holding station including a support means slidable axially of the fin produced in the working station, and holding means supported for rotation by the support means for holding a magnetron body in such a manner that center axes thereof coincide with a center axis of the fin and for moving the magnetron body in an axial direction while rotating the same;

a temporary fixing station including a pivotal lever means supported by the support means of the holding station, and a drive means for the lever means for forcing the fin at one end of the lever means against the magnetron body for temporarily fixing the fin to the magnetron body;

a fixing station supported by said support means of the holding station positioned above the magnetron body held in the holding station for fixing a leading end and a trailing end of the fin wound on the magnetron body; and a cutting station supported by said support means of the holding station and including a fixed blade and a movable blade juxtaposed against each other with the trailing end of the fin wound on the magnetron body being interposed therebetween for partially cutting the fin.

3. An apparatus for producing a magnetron, the apparatus comprising:

suppoly means including a plurality of sets of working roller means for bending one side of a strip of thin material into a substantially L-shape;

working means for receiving the substantially L-shaped material from the supply means including a pair of rolling rolls including a large diameter rolling roller and a small diameter rolling roller which is driven by driving means for rolling the other side of the material to produce the spiral fin;

holding means for supporting a magnetron body in such a manner that a center axis thereof coincides with center axis of the spiral fin, said holding means moving rotating means for rotating the magnetron body by driving means and moving means for moving the magnetron body in an axial direction;

temporary fixing means for temporarily fixing the fin against the magnetron body by forcing a base of the fin against the magnetron body;

fixing means for fixing the spiral fin against the magnetron body by fixing an adjacent fin of each of a leading end and a trailing end of the fin wound on the magnetron body; and cutting means for partially cutting the trailing end of the spiral fin produced by said working means.

* * * * *